US006492891B2

(12) United States Patent
Yamaguchi

(10) Patent No.: US 6,492,891 B2
(45) Date of Patent: Dec. 10, 2002

(54) TRANSFORMER DEVICE, HIGH VOLTAGE GENERATING APPARATUS HAVING THE SAME, AND LIGHTING SYSTEM HAVING THEM

(75) Inventor: Hironao Yamaguchi, Nukata-gun (JP)

(73) Assignee: Denso Corporation, Kariya (JP)

( * ) Notice: Subject to any disclaimer, the term of this patent is extended or adjusted under 35 U.S.C. 154(b) by 14 days.

(21) Appl. No.: 09/879,035

(22) Filed: Jun. 13, 2001

(65) Prior Publication Data

US 2002/0047616 A1 Apr. 25, 2002

(30) Foreign Application Priority Data

Jun. 14, 2000 (JP) ..... 2000-178191
May 21, 2001 (JP) ..... 2001-151042

(51) Int. Cl.[7] ..... H01F 27/30

(52) U.S. Cl. ..... 336/198; 336/196; 336/221; 336/90; 315/276

(58) Field of Search ..... 336/198, 196, 336/221, 90, 96, 98, 82, 83, 213; 315/276, 363

(56) References Cited

U.S. PATENT DOCUMENTS 6,049,163 A * 4/2000 Masuda et al. ..... 313/318.12
6,084,354 A * 7/2000 Kohmura et al. ..... 315/57
6,191,675 B1 * 2/2001 Sudo et al. ..... 336/198
6,201,350 B1 3/2001 Okuchi et al. ..... 315/82

FOREIGN PATENT DOCUMENTS

JP 11297548 10/1999

* cited by examiner

*Primary Examiner*—Don Wong
*Assistant Examiner*—Tuyet T. Vo
(74) *Attorney, Agent, or Firm*—Oliff & Berridge, PLC

(57) ABSTRACT

A transformer device includes a housing made of a dielectric material, a core received within the housing, a secondary coil wound around an outer peripheral surface of the core, a high-voltage terminal connected to a high-voltage side end of the secondary coil and a primary coil electromagnetically coupled with the secondary coil. The housing has an open axial end and a closed axial end. The high-voltage side end of the secondary coil is positioned within the housing adjacent to the closed end of the housing. A high-voltage generating apparatus includes the transformer device received within a metal case. A discharge lamp lighting system includes the high-voltage generating apparatus and a discharge lamp electrically connected to the high-voltage generating apparatus.

11 Claims, 8 Drawing Sheets

TRANSFORMER DEVICE, HIGH VOLTAGE GENERATING APPARATUS HAVING THE SAME, AND LIGHTING SYSTEM HAVING THEM

CROSS REFERENCE TO RELATED APPLICATION

This application is based on and incorporates herein by reference Japanese Patent Application No. 2000-178191 filed on Jun. 14, 2000 and Japanese Patent Application No. 2001-151042 filed on May 21, 2001.

BACKGROUND OF THE INVENTION

1. Field of the Invention

The present invention relates to a transformer device, to a high-voltage generating apparatus having the transformer device received in a metal case, and also to a lighting system having the high-voltage generating apparatus.

2. Description of Related Art

In order to turn on a discharge lamp of a lighting system, a high voltage (e.g., about 20 kV) needs to be applied between electrodes of the discharge lamp. In a transformer device that generates such a high voltage, a voltage to be applied to a primary coil is rapidly switched by a control circuit to generate the high voltage in a secondary coil. A high-voltage generating apparatus includes such a transformer device received within a metal case. In the high-voltage generating apparatus, there are high-voltage portions and low voltage portions. The high-voltage portions include, for example, a high-voltage side end of the secondary coil and a high-voltage terminal electrically connected to the high-voltage side end of the secondary coil. The low-voltage portions include, for example, the metal case, which receives the transformer device, and the control circuit. An electrical discharge (leakage) can take place between the high-voltage portion(s) and the low-voltage portion(s), causing some undesirable results, such as, damage to the control circuit, reduction in the voltage of the secondary coil, or the like.

In order to prevent the electrical leakage between the high-voltage portion(s) and the low-voltage portion(s), a dielectric resin material can be filled around the primary coil and the secondary coil in the transformer device. However, the step of filling the resin material needs to be added to the manufacturing process, resulting in an increase in a manufacturing cost. Alternatively, a space between the high-voltage portion and the low-voltage portion can be increased. However, this normally causes an increase in a size of the high-voltage generating apparatus.

FIG. 17A shows one previously proposed high-voltage generating apparatus 500 having a transformer device 510 received within a metal case 540. The transformer device 510 includes a core 511, a secondary coil 512 wound around the core 511, a dielectric resin housing 520 receiving the core 511 and the secondary coil 512, and a primary coil 513 wound around the housing 520. A high-voltage side end of the secondary coil 512 is connected to a high-voltage terminal 515 to output a high voltage generated in the secondary coil 512 from the transformer device 510. One end of the housing 520 where the high-voltage side end of the secondary coil 512 and the high-voltage terminal 515 are present is open. Thus, once the transformer device 510 is installed within the metal case 540, electrical leakage similar to that described above can take place between the high-voltage portions of the transformer device 510 and the metal case 540 that acts as the low-voltage portion. In order to restrain the electrical leakage between the high-voltage portions of the transformer device 510 and the metal case 540, the high-voltage portions of the transformer device 510 is covered with and received within first and second resin cases 530, 535 that are engaged with each other to provide a substantially closed space therebetween.

As shown in FIGS. 17A and 17B, when an engaging portion 536 of the second resin case 535 is engaged with an engaging portion 531 of the first resin case 530, a maze structure is formed. Because of the maze structure, a creeping distance between the high-voltage portions of the transformer device 510 and the metal case 540 is increased. Thus, the maze structure formed with the first and second resin cases 530 and 535 restrains the electrical leakage between the high-voltage portions of the transformer device 510 and the metal case 540.

However, the presence of the resin cases 530, 535 between the high-voltage portions of the transformer device 510 and the metal case 540 results in an increase in the number of components to be assembled and also results in an increase in a size of the high-voltage generating apparatus 500.

SUMMARY OF THE INVENTION

Thus, it is an objective of the present invention to provide a compact transformer device, which can be readily manufactured with a reduced number of manufacturing steps and can restrain the electrical leakage. It is another objective of the present invention to provide a high-voltage generating apparatus including such a transformer device. It is a further objective of the present invention to provide a lighting system having such a high-voltage generating apparatus.

To achieve the objectives of the present invention, there is provided a transformer device including a housing made of a dielectric material, a core received within the housing, a secondary coil wound around an outer peripheral surface of the core, a high voltage terminal, and a primary coil electromagnetically coupled with the secondary coil for generating the high voltage in the secondary coil. The secondary coil has a high-voltage side end from which a high voltage is outputted. The high-voltage terminal is connected to the high-voltage side end of the secondary coil to output the high voltage from the transformer device. The housing has an open axial end and a closed axial end. The high-voltage side end of the secondary coil is positioned within the housing adjacent to the closed end of the housing.

Furthermore, there is provided a high-voltage generating apparatus including the transformer device and a metal case that receives the transformer device. The metal case is arranged adjacent to the housing of the transformer device.

Also, there is provided a discharge lamp lighting system including a discharge lamp and the high-voltage generating apparatus. The high-voltage generating apparatus is electrically connected to the discharge lamp for generating a high voltage to be supplied to the discharge lamp to turn on the discharge lamp.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments will be discussed below with reference to the accompanying drawings.

(First Embodiment)

Figure 1:
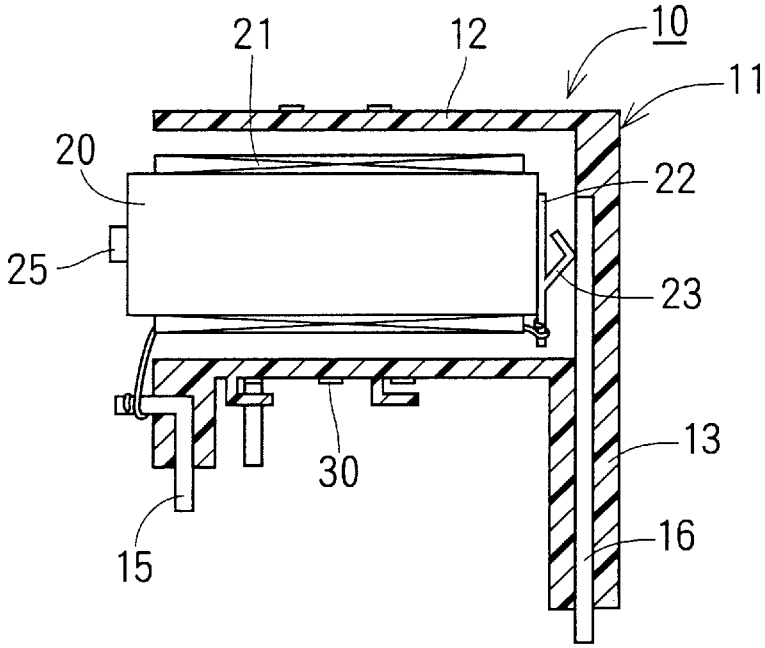
FIG. 1 is a cross-sectional view of a transformer device according to a first embodiment of the present invention.
Figure 2:
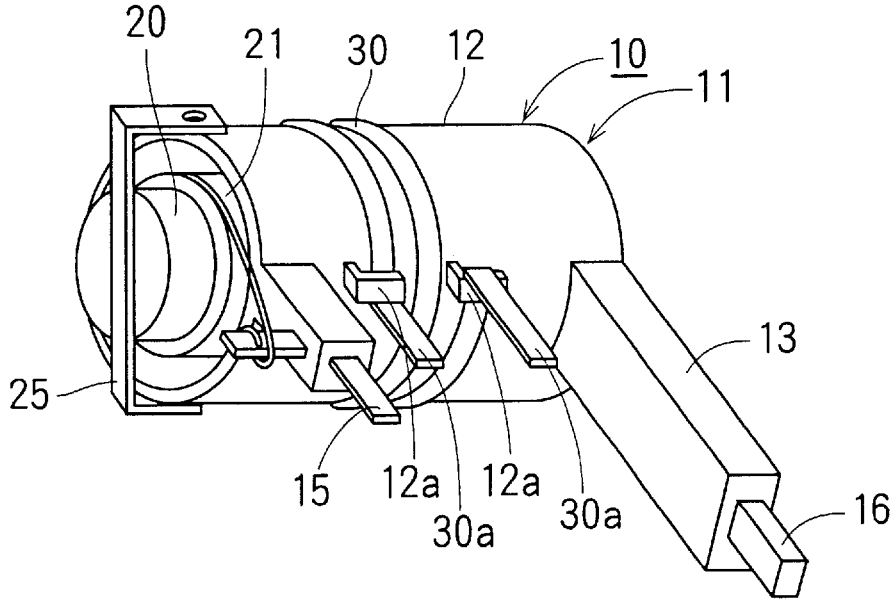
FIG. 2 is a perspective view of the transformer device according to the first embodiment.

A transformer device according to a first embodiment of the present invention will now be described with reference to FIGS. 1 and 2. The transformer device 10 is used to generate a high voltage or boosted voltage by boosting a power supply voltage supplied from, for example, a vehicle battery. The high voltage is then applied from the transformer device 10 to a discharge lamp or power consuming device (not shown) to turn on the same.

A housing 11 of the transformer device 10 is made by molding a dielectric resin material. The housing 11 includes a cylindrical portion 12 and a terminal cover 13. A cylindrical core 20 and a secondary coil 21 are received within the housing 11. A low-voltage terminal 15 and a second terminal 16 are held within the housing 11 by insert molding. The low-voltage terminal 15 is electrically connected with a low-voltage side end of the secondary coil 21. The second terminal 16 is electrically connected to a power supply terminal of the discharge lamp (not shown).

The secondary coil 21 is wound around the cylindrical core 20. A high-voltage side end of the secondary coil 21 is electrically connected to a first terminal 22 at a position that is spaced from an opening (left end in FIG. 1) of the housing 11. The first terminal 22 is adhered to a high-voltage side end surface of the core 20. The first terminal 22 has a resilient portion 23 that is urged against the second terminal 16. The first terminal 22 and the second terminal 16 act as high-voltage terminals. A horseshoe-shaped support member 25 is attached to the housing 11 to urge the core 20 toward the second terminal 16 to prevent the core 20 from coming out of the housing 11.

A primary coil 30 is a long thin ribbon-like material and is wound several turns around an outer peripheral surface of the cylindrical portion 12. Ends 30*a* of the primary coil 30 are hooked to claws 12*a* formed in the outer peripheral surface of the cylindrical portion 12.

While the discharge lamp is turned on, a control circuit (not shown) rapidly switches the power supply to the primary coil 30 of the transformer device 10 between on and off, so that a high voltage is generated in the secondary coil 21 of the transformer device 10. The generated high voltage is supplied to the discharge lamp through the first terminal 22, the second terminal 16, a lead wire (not shown) electrically connected to the second terminal 16, and a power supply terminal (not shown) of the discharge lamp electrically connected to the lead wire to turn on the discharge lamp. The control circuit maintains a constant or steady power supply to the discharge lamp once the discharge lamp is turned on.

In the first embodiment, the housing 11 made by molding the dielectric resin material covers and receives high-voltage portions, which include the high-voltage side end of the secondary coil 21, the first terminal 22 and the second terminal 16. Low-voltage portions, which include the low-voltage terminal 15, the primary coil 30 and the control circuit located near the transformer device 10, are located outside of the housing 11. Thus, a creeping distance between any one of the high-voltage portions and any one of the low-voltage portions is increased. Thus, electrical leakage of the high voltage generated in the secondary coil 21 between the high-voltage portions and the low-voltage portions can be effectively restrained.

Furthermore, when an assembly including the core 20, the secondary coil 21 and the first terminal 22 is inserted within the cylindrical portion 12, the first terminal 22 is electrically, resiliently connected to the second terminal 16 via the resilient portion 23 of the first terminal 22 due to the resilient force. As a result, a step of electrically connecting the first terminal 22 to the second terminal 16 by a lead wire, an adhesive or the like can be eliminated, resulting in a reduced number of manufacturing steps. Furthermore, since the first terminal 22 is urged against the second terminal 16 by the resilient force, the first terminal and the second terminal 16 are securely, electrically connected with each other.

(Second, Third and Fourth Embodiments)

Figure 3:
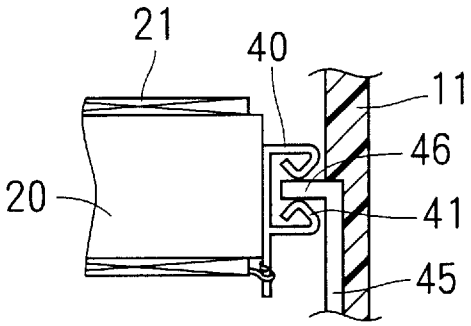
FIG. 3 is a partial cross-sectional view of a transformer device according to a second embodiment of the present invention, showing high-voltage terminals and a structure around them.
Figure 4:
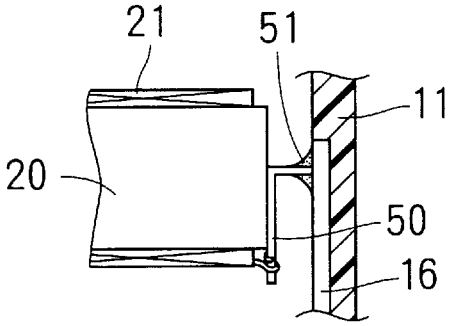
FIG. 4 is a partial cross-sectional view of a transformer device according to a third embodiment of the present invention, showing high-voltage terminals and a structure around them.
Figure 5:
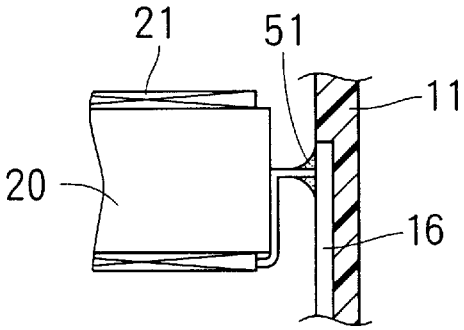
FIG. 5 is a partial cross-sectional view of a transformer device according to a fourth embodiment of the present invention, showing a high-voltage terminal and a structure around it.

Second, third and fourth embodiments of the present invention are depicted in FIGS. 3, 4 and 5, respectively. In each one of these embodiments, a structure of connecting the high-voltage side end of the secondary coil 21 to the second terminal is different from that of the first embodiment.

A first terminal 40 of the second embodiment is adhered to the high-voltage side end surface of the core 20. Furthermore, the first terminal 40 includes opposed resilient portions 41 each one of which is bent into a hook-shape. A second terminal 45 has an end portion 46 that protrudes toward the first terminal 40 from the housing 11. The first terminal 40 and the second terminal 45 act as high-voltage terminals. The resilient portions 41 of the first terminal 40 resiliently clamp and engage with the end portion 46 of the second terminal 45.

When an assembly including the core 20, the secondary coil 21 and the first terminal 40 is inserted within the housing 11, the resilient portions 41 of the first terminal 40 and the end portion 46 of the second terminal 45 are resiliently engaged with each other and are thus electrically connected with each other. As a result, a step of electrically connecting the first terminal 40 to the second terminal 45 by a lead wire, an adhesive or the like can be eliminated, resulting in a reduced number of manufacturing steps. Furthermore, since the first terminal 40 is engaged with the second terminal 45 by the resilient force, the first terminal 40 and the second terminal 45 are securely, electrically connected with each other.

A first terminal 50 of the third embodiment acting as the high-voltage terminal is adhered to a high-voltage side end surface of the core 20. An end portion of the first terminal 50 extends toward a second terminal 16. The first terminal 50 and the second terminal 16 are secured together with an electrically conductive adhesive 51. Even if the first terminal 50 and the second terminal 16 do not directly contact each other, the electrically conductive adhesive 51 securely, electrically connects the first terminal 50 to the second terminal 16.

In the fourth embodiment, the high-voltage side end of the secondary coil 21 extends on the second terminal 16 side. The high-voltage side end of the secondary coil 21 is secured to the second terminal 16 with the electrically conductive adhesive 51. Since the high-voltage side end of the secondary coil 21 is directly and electrically connected to the second terminal 16, the first terminal 50 of the third embodiment is not required in the fourth embodiment. As a result, the number of manufacturing steps is advantageously reduced. Furthermore, even if the high-voltage side end of the secondary coil 21 is not directly connected to the second terminal 16, the high-voltage side end of the secondary coil 21 and the second terminal 16 are securely, electrically connected together by the electrically conductive adhesive 51.

(Fifth and Sixth Embodiments)

Figure 6:
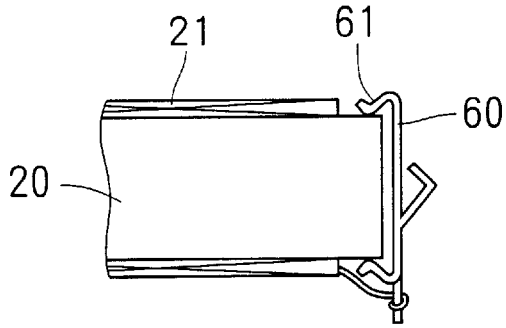
FIG. 6 is a partial cross-sectional view of a transformer device according to a fifth embodiment of the present invention, showing a high-voltage terminal and a structure around it.
Figure 7:
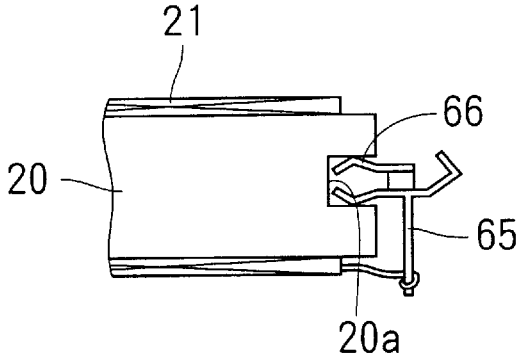
FIG. 7 is a partial cross-sectional view of a transformer device according to a sixth embodiment of the present invention, showing a high-voltage terminal and a structure around it.

Fifth and sixth embodiments of the present invention will be described with reference to FIGS. 6 and 7, respectively. In these fifth and sixth embodiments, a way of connecting the first terminal to the core 20 is different from that of the first embodiment.

A first terminal 60 of the fifth embodiment acting as the high-voltage terminal has opposing claws 61. The claws 61 resiliently engage with the outer peripheral surface of the high-voltage side end of the core 20. The first terminal 60 is resiliently urged against the second terminal 16.

In the sixth embodiment, a recess 20*a* is formed in the high-voltage side end of the core 20. A first terminal 65 acting as the high-voltage terminal has opposing claws 66 that extend toward the recess 20*a*. The claws 66 resiliently engages the recess 20*a*. The first terminal 65 is resiliently urged against the second terminal 16.

In the fifth and sixth embodiments, rather than using the adhesive, the first terminal 60 or 65 is connected to the core 20 by the engagement between the first terminal 60 or 65 and the core 20, allowing easier manufacturing of the transformer device 10.

(Seventh Embodiment)

Figure 8:
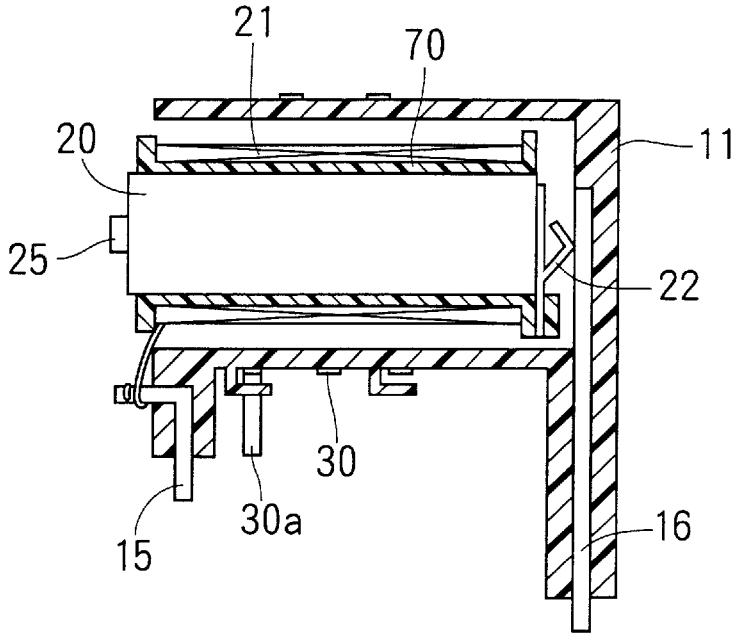
FIG. 8 is a cross-sectional view of a transformer device according to a seventh embodiment of the present invention.

A seventh embodiment of the present invention is shown in FIG. 8. In the seventh embodiment, components similar to those of the first embodiment are depicted with similar numerals. A spool 70 made by molding a dielectric resin material is securely fitted around the outer peripheral surface of the core 20. The secondary coil 21 is wound around an outer peripheral surface of the spool 70.

(Eighth Embodiment)

Figure 9:
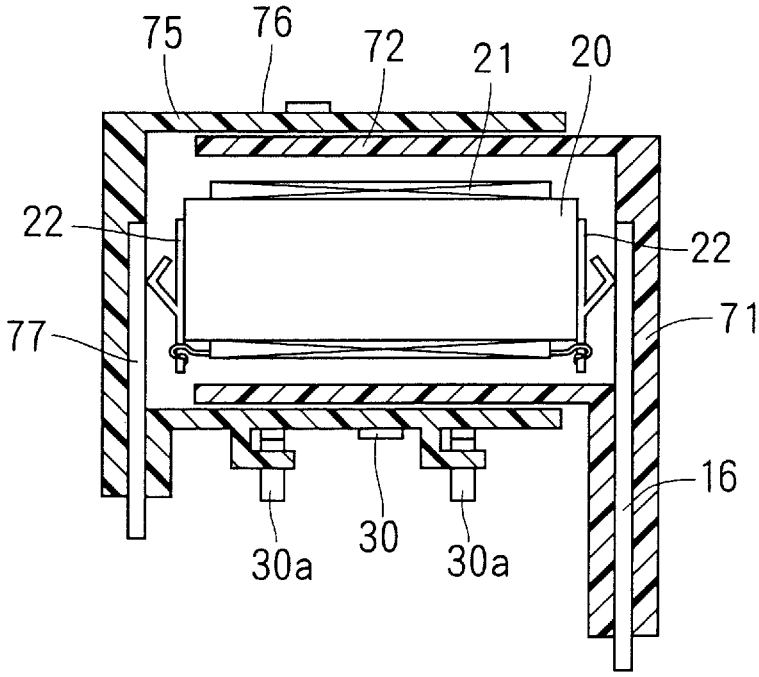
FIG. 9 is a cross-sectional view of a transformer device according to an eighth embodiment of the present invention.

An eighth embodiment of the present invention is shown in FIG. 9. Components similar to those of the first embodiment are depicted with similar numerals. In the eighth embodiment, in addition to the first terminal 22 adhered to the high-voltage side end surface of the core 20, another first terminal 22 is adhered to a low-voltage side end surface of the core 20. A first housing part 71 made by molding a dielectric resin material has a cylindrical portion 72 that receives the secondary coil 21 wound around the core 20. A second housing part 75 includes a low-voltage terminal 77 molded within the second housing part 75 by insert molding. A cylindrical portion 76 of the second housing part 75 engages an outer peripheral surface of the cylindrical portion 72 of the first housing part 71. The primary coil 30 is wound around an outer peripheral surface of the cylindrical portion 76 of the second housing part 75.

The secondary coil 21 is entirely surrounded by the first and second housing parts 71, 75 made of the dielectric resin material. Thus, a creeping distance between any one of the high-voltage portions of the transformer device and any one of the low-voltage portions of the transformer device and the other low-voltage portions located outside of the first and second housing parts 71, 75 is further increased. As a result, the electrical leakage can be further restrained between the high-voltage portions of the transformer device and the low-voltage portions of the transformer device and the other low-voltage portions located outside of the first and second housing parts 71, 75.

(Ninth Embodiment)

Figure 10:
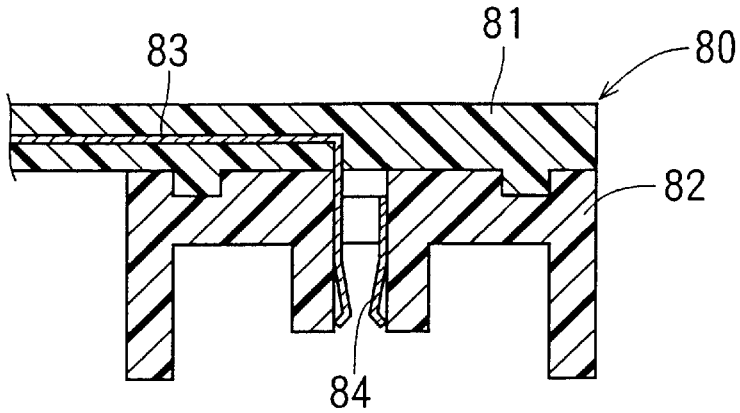
FIG. 10 is a partial cross-sectional view of a power supply connector according to a ninth embodiment of the present invention.
Figure 11:
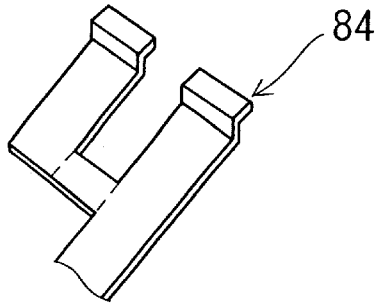
FIG. 11 is a partial perspective view of a power supply terminal according to the ninth embodiment of the present invention.

A ninth embodiment of the present invention is shown in FIG. 10. A power supply connector 80 of the discharge lamp includes a terminal cover 81 and a connector portion 82 that is to be connected to the discharge lamp. The terminal cover 81 is integrally molded from a resin material together with the housing of the transformer device that receives the secondary coil. A second terminal 83 that is electrically connected to the high-voltage side end of the secondary coil is molded within the terminal cover 81 by insert molding. The second terminal 83 has a power supply terminal 84 that is integrally formed with the second terminal 83 and is electrically connected to the electrode of the discharge lamp. With reference to FIG. 11, the power supply terminal 84 is folded along dotted lines shown in FIG. 11, for example, by punching or by pressing to provide a shape shown in FIG. 10.

Figure 15:
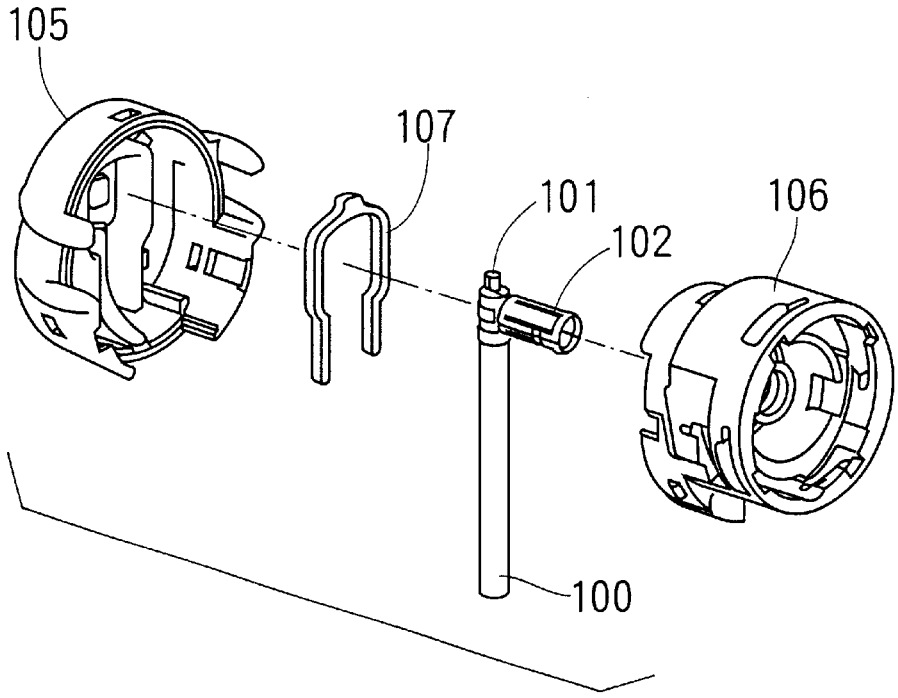
FIG. 15 RELATED ART
FIG. 15 is a perspective exploded view of a power supply connector provided as a comparative example.
Figure 16:
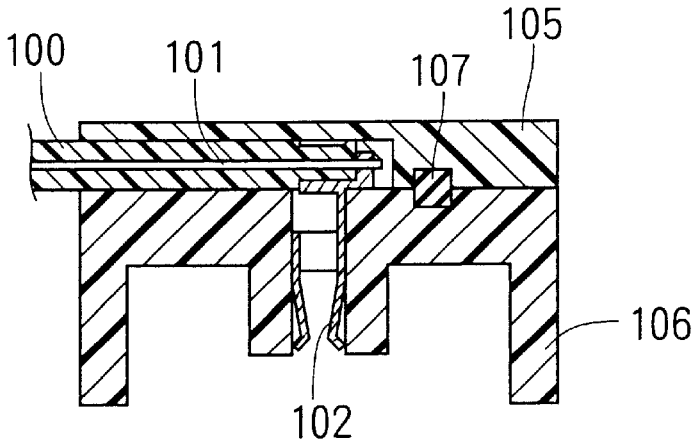
FIG. 16 RELATED ART
FIG. 16 is a partial cross-sectional view of the power supply connector provided as the comparative example.

With reference to FIGS. 15 and 16, a comparative example in which the high voltage is applied to the discharge lamp from the transformer device will be described. A lead main body 101 of a lead wire 100 that is electrically connected to the high-voltage terminal of the transformer device is electrically connected to a power supply terminal 102 on the discharge lamp side. The lead wire 100 and the power supply terminal 102 are clamped between a resin cover 105 and a connector portion 106 to be connected to the discharge lamp. A seal rubber 107 is clamped between the resin cover 105 and the connector portion 106 in such a manner that the seal rubber 107 surrounds a connection between the lead wire 100 and the power supply terminal 102.

As described above, the lead wire 100 electrically connects the transformer device to the discharge lamp side component, so that connecting steps are required to electrically connect ends of the lead wire 100 to the transformer device and the discharge lamp side component, respectively. Contrary to this, in the ninth embodiment shown in FIGS. 10 and 11, the second terminal 83 molded within the housing of the transformer device has the power supply terminal 84 that is to be electrically connected to the electrode of the discharge lamp, so that there is no need to provide the lead wire. As a result, the number of the manufacturing steps can be reduced.

(Tenth Embodiment)

Figure 12:
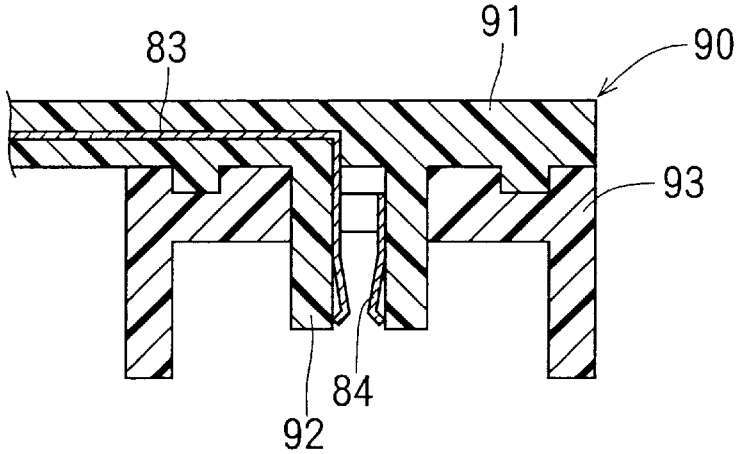
FIG. 12 is a partial cross-sectional view of a power supply connector according to a tenth embodiment.

A tenth embodiment of the present invention is shown in FIG. 12. A power supply connector 90 of the discharge lamp includes a terminal cover 91 and a connector portion 93 to be connected to the discharge lamp. The terminal cover 91 is integrally molded with the housing of the transformer device that receives the secondary coil. The terminal cover 91 includes a cylindrical portion 92 that protrudes toward the connector portion 93. The cylindrical portion 92 surrounds an outer peripheral portion of the power supply terminal 84. Since the second terminal 83 is buried within the housing integrally molded therewith and is not disposed to a boundary surface of the housing, electrical leakage along the boundary surface can be restrained.

(Eleventh Embodiment)

Figure 13A:
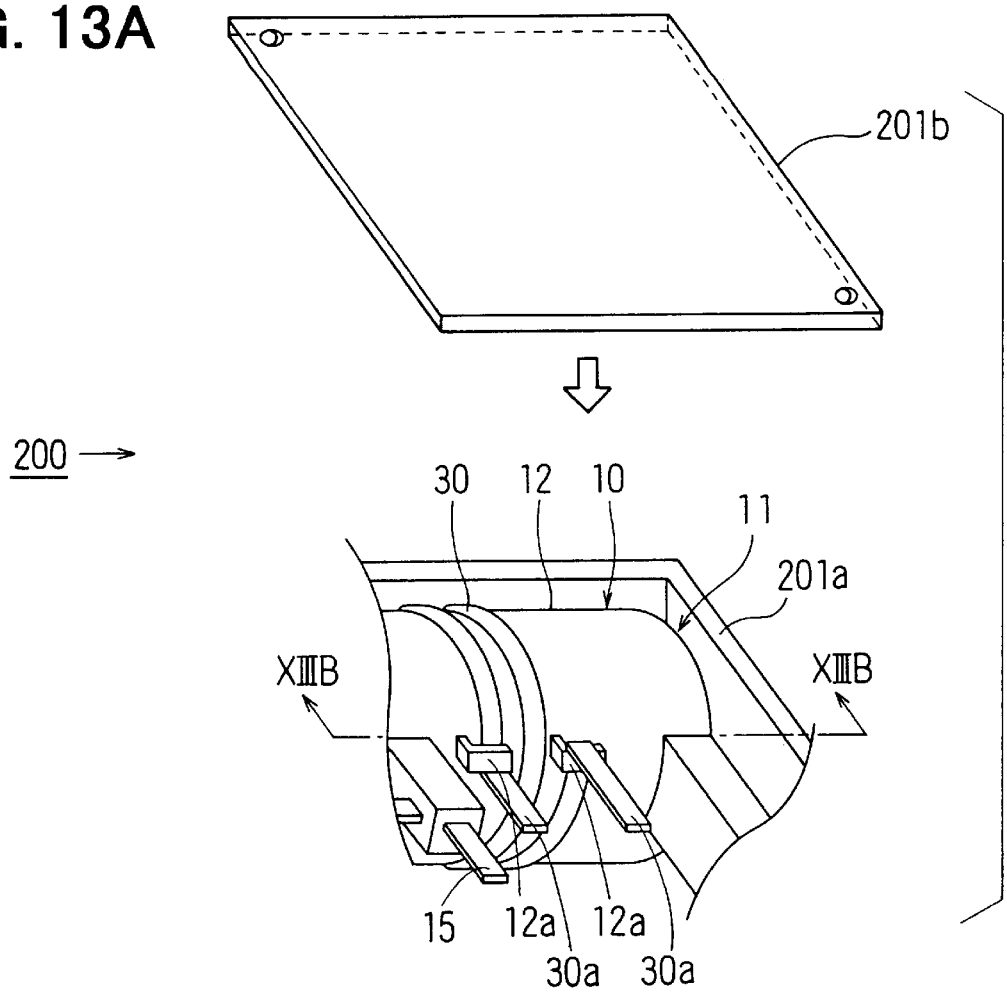
FIG. 13A is a partial perspective view of a high-voltage generating apparatus according to an eleventh embodiment of the present invention.
Figure 13B:
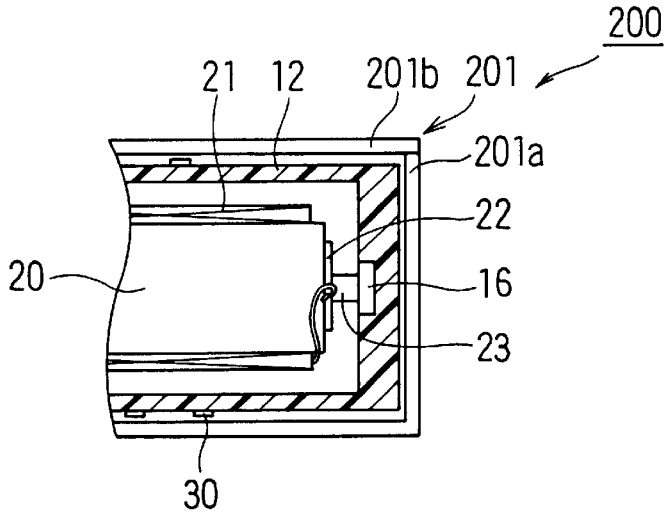
FIG. 13B is a cross-sectional view taken along line XIII—XIII in FIG. 13A.

FIGS. 13A and 13B show a high-voltage generating apparatus 200 having the transformer device 10 according to the first embodiment received in a metal case 201. As shown in FIG. 13A, the metal case 201 includes a container portion 201*a* and a cover portion 201*b*. The cover portion 201*b* covers an opening of the container portion 201*a* that receives the transformer device 10 therein.

Figure 14:
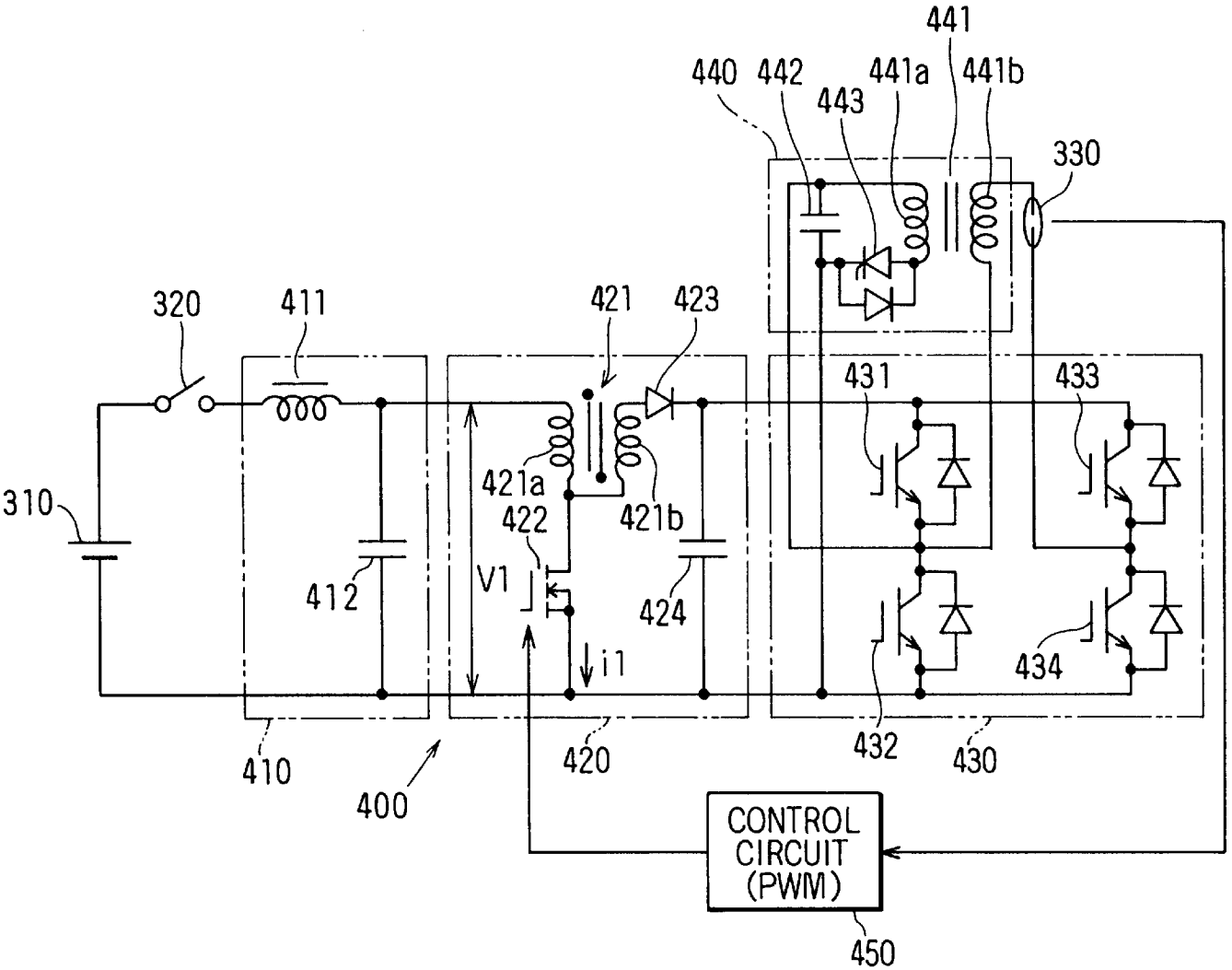
FIG. 14 is a circuit diagram showing a vehicle discharge lamp lighting system according the eleventh embodiment.

FIG. 14 shows a discharge lamp lighting system 400 of a vehicle including a high-voltage generating apparatus, such as the high-voltage generating apparatus 200 shown in FIGS. 13A and 13B, and a discharge lamp 330, such as a metal halide lamp. The lighting system 400 is connected to a vehicle battery 310. When a lamp lighting switch 320 is turned on, the discharge lamp 330 is turned on.

The high-voltage generating apparatus includes a filter circuit 410, a DC/DC converter 420, an inverter circuit 430, a start circuit 440 and a control circuit 450.

The filter circuit 410 includes a coil 411 and a capacitor 412 and filters noises.

The DC-DC converter 420 includes a flyback transformer 421, a MOS transistor (field effect transistor) 422, a rectifying diode 423 and a smoothing capacitor 424. The flyback transformer 421 includes a primary coil (winding) 421 a arranged on a battery 310 side thereof and a secondary coil (winding) 421*b* arranged on a lamp 330 side thereof. The MOS transistor 422 is connected to the primary coil 421*a* and acts as a semiconductor switching element. The diode 423 is connected to the secondary coil 421*b*. The DC-DC converter 420 boosts a battery voltage. That is, in the DC-DC converter 420, when the MOS transistor 422 is turned on, primary current is applied to the primary coil 421*a*, so that energy is accumulated in the primary coil 421*a*. When the MOS transistor 422 is turned off, the energy in the primary coil 421*a* is supplied to the secondary coil 421*b*. By repeating on and off of the MOS transistor 422, a high voltage is outputted from a connection between the rectifying diode 423 and the smoothing capacitor 424. The flyback transformer 421 is constructed in such a manner that electrical conduction is allowed between the primary coil 421*a* and the secondary coil 421*b*, as shown in FIG. 14.

The inverter circuit 430 includes MOS transistors 431–434 acting as semiconductor switching elements connected in an H-bridge configuration. The inverter circuit 430 is provided to operate the lamp 330 with alternating current. One diagonal pair of the MOS transistors 431 and 434 and another diagonal pair of the MOS transistor 432 and 433 are alternately and continuously turned on and off by a bridge drive circuit (not shown).

The start circuit 440 includes a transformer 441 (such as one similar to the transformer device 10 of the high-voltage generating apparatus 200 shown in FIG. 13A and 13B), a capacitor 442 and a thyristor 443 acting as an unidirectional semiconductor element. The transformer 441 includes a primary coil (winding) 441*a* and a secondary coil (winding) 441*b*. The start circuit 440 turns on the lamp 330. That is, when the lighting switch 320 is turned on, the capacitor 442 is charged. Thereafter, when the thyristor 443 is turned on, the capacitor 442 is discharged to apply a high voltage to the lamp 330 through the transformer 441. As a result, the lamp 330 is turned on upon dielectric breakdown between electrodes of the lamp 330.

Based on signals (lamp power signals) indicative of a lamp voltage and a lamp current of the lamp 330 measured with a sensor circuit (not shown), the control circuit 450 controls the MOS transistor 422 through pulse width modulation (PWM) control in such a manner that a maximum power (e.g., 65 W) is provided to the lamp 330 at an initial lighting period of the lamp 330 and provides a steady power (e.g., 35 W) during a steady lighting period of the lamp 330 after the initial lighting period.

Operation of the discharge lamp lighting system 400 having the above structure will be briefly described below.

When the lighting switch 320 is turned on, the control circuit 450 controls the MOS transistor 422 through the PWM control, so that the flyback transformer 421 is operated to output the boosted voltage generated by boosting the battery voltage from the DC-DC converter circuit 420. The high voltage outputted from the DC-DC converter circuit 420 is supplied to the capacitor 442 of the start circuit 440 through the inverter circuit 430 to charge the capacitor 442. Thereafter, when the thyristor 443 is turned on, the capacitor 442 is discharged, so that the high voltage is applied to the lamp 330 through the transformer 441. As a result, the lamp 330 is turned on.

After the lamp 330 is turned on, the one diagonal pair of transistors 431 and 434 and the other diagonal pair of transistors 432 and 433 are alternately and continuously turned on and off at a high frequency. Furthermore, the control circuit 450 controls the MOS transistor 422 through the PWM control based on signals indicative of the lamp voltage and the lamp current in such a manner that the maximum power (e.g., 65 W) is provided to the lamp 330 at the initial lighting period of the lamp 330 and provides the steady power during the steady lighting period of the lamp 330. Through this control process, the state of the lamp 330 is shifted from the initial lighting state to the steady lighting state via a transitional state.

With reference to FIGS. 13A, 13B and 14, in the above-described discharge lamp lighting system 400, the filter circuit 410, the DC-DC converter circuit 420, the inverter circuit 430 and the start circuit 400 are received in a metal case (not shown in FIG. 14), such as the metal case 201 of FIGS. 13A and 13B. During the PWM control of the MOS transistor 422 of the DC-DC converter circuit 420, switching noises are generated. However, these switching noises are shielded by the metal case. Thus, the switching noises due to the PWM control of the MOS transistor 422 are substantially eliminated at the outside of the metal case. Furthermore, when the transistors 431–434 are alternately and continuously turned on and off at the high frequency during the steady lighting state of the lamp 330, switching noises are generated. However, these switching noises are also substantially eliminated by the metal case.

Figure 17A:
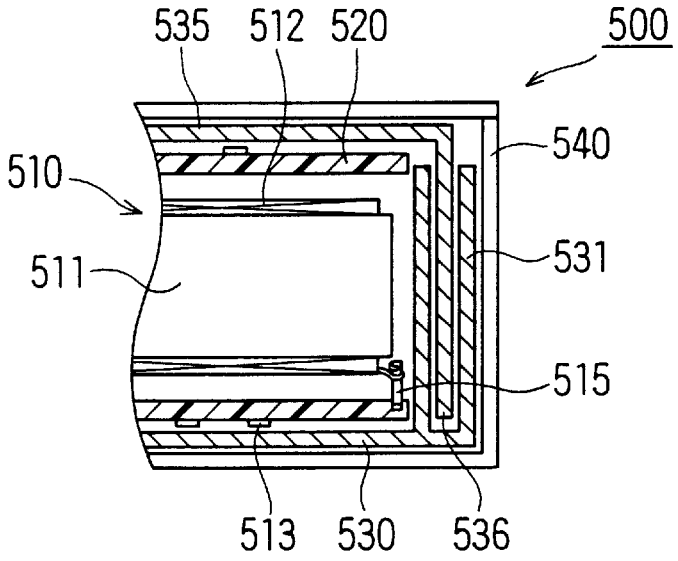
FIG. 17A RELATED ART
FIG. 17A is a partial cross-sectional view of a previously proposed high-voltage generating apparatus having resin cases and a metal case.
Figure 17B:
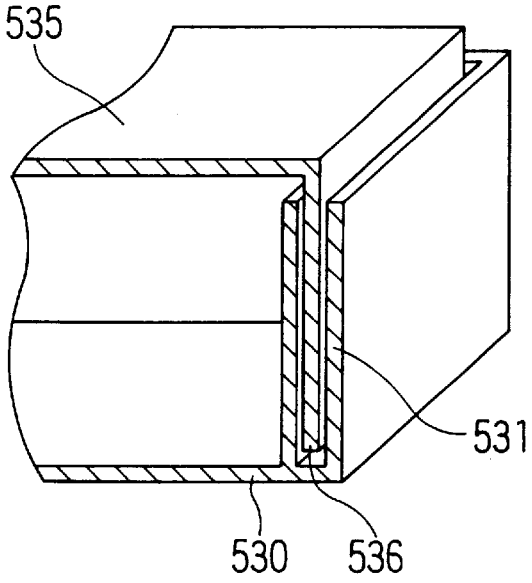
FIG. 17B RELATED ART
FIG. 17B is a partial perspective cross-sectional view of the resin cases of the previously proposed high-voltage generating apparatus shown in FIG. 17A.

As discussed in the first embodiment, the housing 11 of the transformer device 10 made of the dielectric resin material covers and receives the high-voltage portions including the high-voltage side end of the secondary coil 21, the first terminal 22 and the second terminal 16. Thus, the creeping distance between the high-voltage portions of the transformer device 10 and the metal case 201 acting as a low-voltage portion is increased in comparison to that of the previously proposed structure shown in FIGS. 17A and 17B. As a result, the electrical leakage between the high-voltage portions of the transformer device 10 and the metal case 210 can be restrained without necessitating any other leak preventive member that restrains the leakage of the high voltage generated in the transformer device 10. Thus, the number of the components in the high-voltage generating apparatus 200 is reduced, and the size of the high-voltage generating apparatus 200 can be reduced to provide the compact high-voltage generating apparatus.

In the high-voltage generating apparatus 200 of the eleventh embodiment, the transformer device 10 of the first embodiment is received in the metal case 210. However, the transformer device according to any one of the second to tenth embodiments can be received in the metal case 210.

In the various embodiments discussed above, the high-voltage side end of the secondary coil and the high-voltage terminal that is electrically connected to the high-voltage side end of the secondary coil are received within the housing molded from the dielectric resin material. Since the housing is placed between the high-voltage portions located within the housing and the low-voltage portions located outside of the housing, the creeping distance is increased. Thus, the electrical leakage between the high-voltage portions and the low-voltage portions can be restrained.

In the present invention, the control circuit that turns on and off the power supply voltage to the primary coil can be arranged at an outer peripheral surface of the housing within the metal case.

Additional advantages and modifications will readily occur to those skilled in the art. The invention in its broader terms is therefore, not limited to the specific details, representative apparatus, and illustrative examples shown and described.

What is claimed is:

1. A transformer device comprising:

a housing made of a dielectric material, said housing including an open axial end and a closed axial end;

a core received within said housing;

a secondary coil wound around an outer peripheral surface of said core, said secondary coil having a high-voltage side end from which a high voltage is outputted, said high-voltage side end of said secondary coil being positioned within said housing adjacent to said closed end of said housing;

a high-voltage terminal connected to said high-voltage side end of said secondary coil to output said high voltage from said transformer device; and a primary coil electromagnetically coupled with said secondary coil for generating said high voltage in said secondary coil.

2. A transformer device according to claim 1, wherein said primary coil is wound around an outer peripheral surface of said housing.

3. A transformer device according to claim 1, wherein:

said high-voltage terminal is secured to said housing; and said high-voltage side end of said secondary coil is securely connected to said high-voltage terminal with an electrically conductive adhesive.

4. A transformer device according to claim 1, wherein:

said housing constitutes at least a portion of a power supply connector that is to be coupled with a power consuming device; and said high-voltage terminal is electrically connected with a power supply terminal to be electrically connected to said power consuming device.

5. A transformer device according to claim 4, wherein said housing is made as a one-piece member and receives both said high-voltage terminal and said power supply terminal.

6. A transformer device according to claim 1, wherein said high-voltage terminal includes:

a first terminal directly electrically connected to said high-voltage side end of said secondary coil; and a second terminal secured to said housing, said second terminal being electrically connected to said first terminal and extending out of said housing.

7. A transformer device according to claim 3, wherein said first terminal is resiliently urged against said second terminal to form an electrical connection therewith.

8. A transformer device according to claim 6, wherein said first terminal is securely connected to said second terminal with an electrically conductive adhesive.

9. A high-voltage generating apparatus comprising:

a transformer device according to claim 1; and a metal case receiving said transformer device, said metal case being arranged adjacent to said housing of said transformer device.

10. A high-voltage generating apparatus according to claim 9, further comprising:

a switching element connected to said primary coil of said transformer device for switching on and off power supply to said primary coil to generate said high voltage in said secondary coil, said switching element being received in said metal case.

11. A discharge lamp lighting system comprising:

a discharge lamp; and a high-voltage generating apparatus according to claim 9 being electrically connected to said discharge lamp for generating a high voltage to be supplied to said discharge lamp to turn on said discharge lamp.

* * * * *